United States Patent [19]

Michaels, Jr.

[11] Patent Number: 4,478,056

[45] Date of Patent: Oct. 23, 1984

[54] ECONOMIZER CONTROL ASSEMBLY FOR REGULATING THE VOLUME FLOW OF OUTDOOR AMBIENT AIR

[75] Inventor: Donald D. Michaels, Jr., Manchester, Tenn.

[73] Assignee: Carrier Corporation, Syracuse, N.Y.

[21] Appl. No.: 427,404

[22] Filed: Sep. 29, 1982

[51] Int. Cl.[3] ..... F25B 25/00

[52] U.S. Cl. ..... 62/332; 49/404; 74/102; 98/41 SV; 165/16

[58] Field of Search ..... 165/16; 49/362, 404; 98/41 SV; 74/101, 102; 62/332

[56] References Cited

U.S. PATENT DOCUMENTS

| | | | |
|---|---|---|---|
| 1,591,497 | 7/1926 | Reeves | 49/362 X |
| 2,323,523 | 7/1943 | Doering et al. | 74/101 X |
| 2,345,594 | 4/1944 | Gardner | 49/362 |
| 2,936,692 | 5/1960 | White | 98/41 SV |
| 3,830,146 | 8/1974 | Kaiser | 98/41 SV |
| 3,918,201 | 11/1975 | Graziano | 49/362 X |
| 4,366,649 | 1/1983 | Weigant | 49/362 |
| 4,389,853 | 6/1983 | Hile | 165/16 X |

*Primary Examiner*—William E. Tapolcai
*Attorney, Agent, or Firm*—Robert H. Kelly

[57] ABSTRACT

An economizer assembly is disclosed wherein a sliding door is utilized for covering an outdoor ambient air opening allowing outdoor ambient air flow into a space to be conditioned. A motor shaft arrangement connected via a rotating drive rod is utilized to slidably displace the door to any position necessary to effectively regulate air flow. The utilization of this economizer control arrangement with a rooftop type air conditioning unit is further disclosed.

6 Claims, 2 Drawing Figures

ECONOMIZER CONTROL ASSEMBLY FOR REGULATING THE VOLUME FLOW OF OUTDOOR AMBIENT AIR

BACKGROUND OF THE INVENTION

1. Field of the Invention

This invention relates generally to an economizer for regulating the flow of outdoor ambient air into an enclosure to be conditioned. More specifically, the present invention concerns a damper and drive arrangement for controlling outdoor ambient air flow into an air conditioning unit.

2. Prior Art

A typical rooftop type packaged air conditioning unit includes a refrigeration circuit having a compressor, a condenser, an evaporator and an expansion device. The unit is divided into an indoor section wherein indoor air is circulated from the enclosure to the unit and is circulated by a fan back to the enclosure after being appropriately conditioned. An economizer for allowing outdoor ambient air to enter the indoor section may also be provided. The outdoor section typically includes a compressor and condenser as well as an outdoor fan for circulating outdoor ambient air in heat exchange relation with the condenser.

To effectively utilize the economizer, outdoor ambient air is circulated to the indoor section of the unit and to the enclosure when the temperature of the ambient air is such that cooling is provided without operation of the refrigeration circuit. Typical control systems for regulating flow of outdoor ambient air into the indoor section of the air conditioning unit include rotatable damper blades for effecting volume flow rate control of the outdoor ambient air entering the unit. These economizer dampers are often controlled by an electric motor and often have just open and closed positions or a small number of selected positions. Sophisticated electric motors are available for regulating dampers in numerous positions, however, such devices are costly and may require sophisticated control circuitry. Additionally, rotatable damper blades are difficult to seal and typically there is air leakage therethrough when the blades are in a closed position.

The herein described economizer apparatus concerns utilizing a solid sliding door in combination with a frame defining an opening such that a single solid member is positioned to regulate the size of the opening through which outdoor ambient air may enter the unit. A motor is connected to a shaft which is connected to the door via a drive rod. The motor is designed to turn the shaft at very slow speeds such that an approximately one-half shaft revolution results in complete opening and closing of the door thereby moving the economizer between the fully open and fully closed positions. The drive rod is capable of being rotated by the shaft and sliding such that the distance between the shaft and the pivot point to which the rod is connected to the door varies as the door is slid between positions. The solid door allows for a minimum leakage sealed closing of the opening for allowing the ambient air to enter the unit and provides for positioning the door at any position to regulate the flow of air into the unit. Additionally, a relatively inexpensive motor, such as a motor used for directly rotating television antennas may be utilized to position the door in any location. Other motors would also be acceptable.

SUMMARY OF THE INVENTION

It is an object of the present invention to provide an economizer control for regulating outdoor ambient air flow into an air conditioning unit.

It is a further object of the present invention to provide an economizer including a solid door assembly for regulating the volume of air flow into a space to be conditioned.

It is yet another object of the present invention to provide an economizer air flow regulating apparatus capable of being positioned to vary the amount of outdoor ambient air flow therethrough.

It is another object of the present invention to provide an economizer assembly having a closure means which is relatively air tight.

It is a further object of the present invention to provide apparatus for regulating the positioning of the economizer door.

It is a further object of the present invention to provide a safe, economical, reliable and easy to manufacture economizer assembly.

Other objects will be apparent from the description to follow and the appended claims.

These and other objects are achieved in accordance with the present invention by the provision of an air conditioning unit having a refrigeration circuit for transferring heat energy between air being circulated through the unit to a space to be conditioned and a fluid which includes an economizer having a frame defining an opening for an air flow path for allowing outdoor ambient air to enter the air conditioning unit, a sliding non-rotating door assembly for selectively covering at least a portion of the opening defined by the frame to regulate the flow of outdoor ambient air through the economizer and means for displacing the door assembly relative to the frame defining the opening. The means for displacing may further include a reversing motor, a shaft connected to the motor for rotational displacement and at least one rod connecting the shaft to the door to effect sliding movement of the door as a result of the rotational motion of the shaft. The economizer assembly is not limited in use to an application with an air conditioning unit but may be included with an air handling device where it is desirable to circulate outdoor ambient air into an air flow path serving a space to be conditioned.

DESCRIPTION OF THE PREFERRED EMBODIMENT

The apparatus as described herein will refer to an economizer assembly arranged for use with a rooftop type air conditioning unit. It is to be understood that this economizer assembly may be equally utilized with an air handling device not including a refrigeration circuit or other ventilating means. The present invention is described including a specific arrangement for translating rotational displacement into sliding displacement to regulate the position of the door. It is to be understood that other equivalents are available for accomplishing translation of rotational into sliding displacement.

Figure 1:
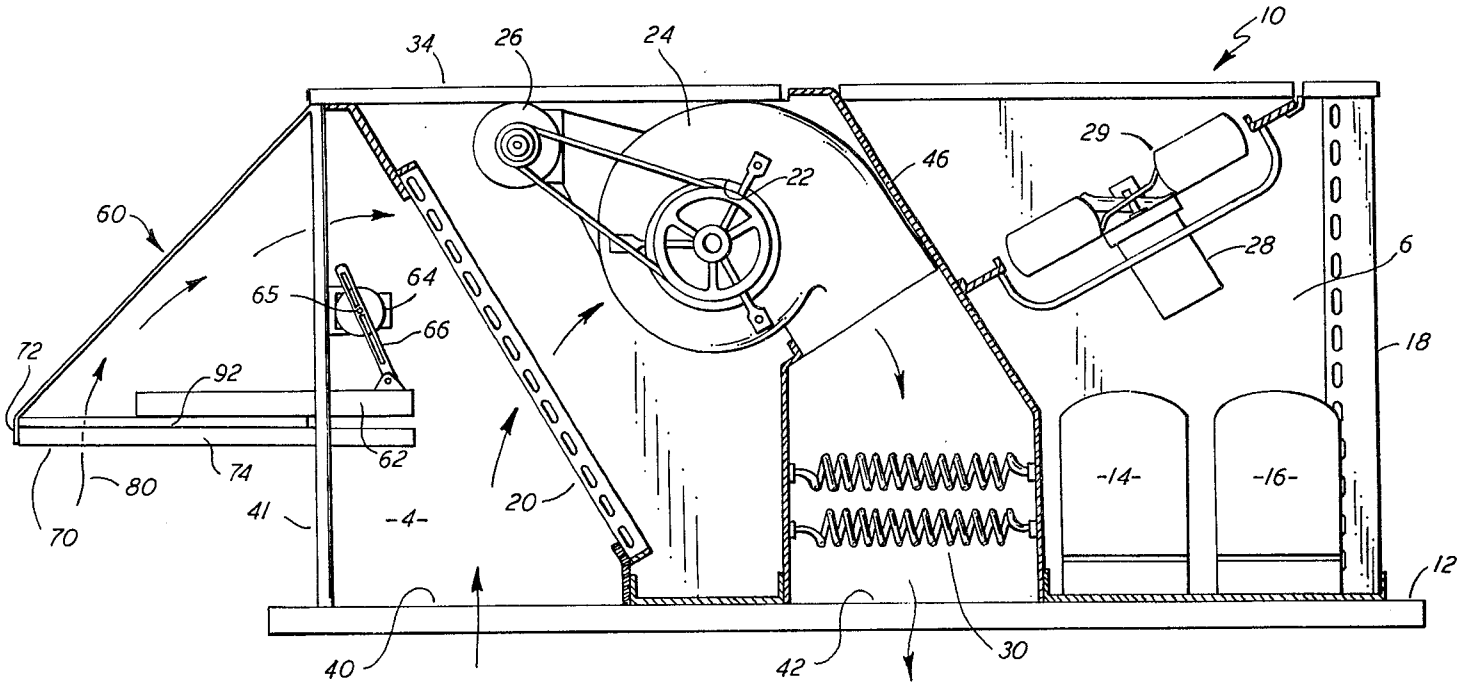
FIG. 1 is a schematic view of a rooftop type air conditioning unit including an economizer assembly.

Referring now to FIG. 1 there may be seen a schematic view of a rooftop type air conditioning unit. Unit 10 is shown mounted to roof curb 12 which is typically secured to the roof of an enclosure. The air conditioning unit is divided by partition 46 into outdoor section 6 and indoor section 4. The unit includes side casing 41 and top casing 34 defining the structure defining the unit. Economizer 60 is shown connected to indoor section 4.

Outdoor section 6 of the air conditioning unit includes compressors 14 and 16, condenser 18 and fan motor 28 mounted to power condenser fan 29. During operation condenser fan 29 acts to draw outdoor ambient air through the condenser and to discharge that air upwardly out of the unit to effect cooling of hot refrigerant within the condenser.

Within indoor section 4 of the unit may be seen the air flow path for directing air to the enclosure. Arrows are shown to indicate that air from the enclosure may enter the unit through supply air opening 40 and flow upwardly through evaporator 20 and then into fan 22 and thereafter be discharged downwardly through electric resistance heaters 30 and out return air opening 42 back to the enclosure to be conditioned. Fan 22 is mounted within fan scroll 24 and is powered by indoor fan motor 26. Additionally, outdoor ambient air may enter through opening 80 defined by frame 70 of economizer 60. This outdoor ambient air flows through filter 72 through opening 80 and then into the indoor section of the unit where it may flow through the evaporator prior to entering indoor fan 22. Economizer 60 is shown having a door 62 located for sliding motion relative to frame 70 for covering opening 80. Motor 64 is shown connected to a drive rod 66 which is connected to the pivot point of door 62 for effecting sliding motion of the door via rotational movement of the motor.

Figure 2:
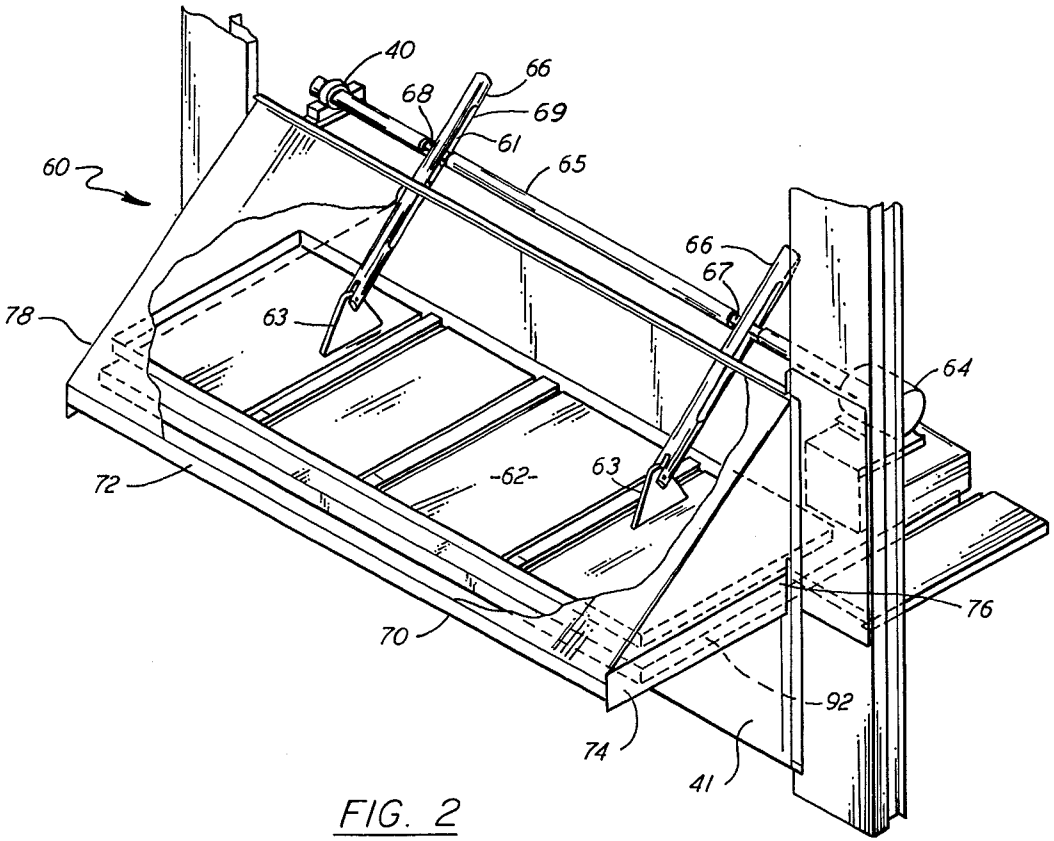
FIG. 2 is a perspective view of the economizer assembly suitable for being connected to apparatus for receiving outdoor ambient air.

Referring now to FIG. 2 there may be seen an enlarged perspective view of the economizer assembly. Frame 70 including front frame portion 72, side frame portions 74 and 78 and back frame portion 76 define an opening within economizer 60 such that outdoor ambient air may be drawn therethrough. Air filter 72 is shown mounted within the incoming air flow stream for the removal of unwanted particulates.

Door 62 is shown mounted on the top of various portions of frame 70 in sliding engagement therewith. Door 62 has extending upwardly therefrom pivot supports 63 each of which is pivotally connected to drive rods 66. Motor 64 is shown secured to shaft 65 for effecting rotational movement thereof. Drive rod 66 is connected to shaft 65 via a sliding union such that the rotational movement of the shaft is imparted to the drive rod and the drive rod may be displaced relative to the shaft. The opposite end of shaft 65 from motor 64 is secured in the bearing 90. Multiple drive rods are used on the same shaft to effect coordinated and smooth control of the displacement of the door. As may be seen in FIG. 2, it is the door that is moved forward and backward such that various portions of the opening are covered and uncovered to regulate the size of the opening and thereby regulate the flow of outdoor ambient air into the economizer. Although not shown, a sealing means may be provided between the frame and the door to reduce air leakage.

The drive rod may be connected to the shaft via a sliding union which includes a first portion 67 secured to the shaft to rotate therewith and rotating flat planar surfaces 68 for engaging the drive rod. The drive rod has a longitudinally extending opening 69 having interior surfaces 61 in engagement with the rotating surfaces 68 to effect rotational movement of the drive rod. The first portion 67 may slide within the opening 69 to allow displacement of the rod relative to the shaft while maintaining the transmission of rotational displacement between the shaft and the drive rod.

The herein invention has been described with reference to a particular embodiment. It is to be understood by those skilled in the art that various changes and modifications can be made and equivalents substituted for the elements thereof without departing from the spirit and the scope of the invention.

What is claimed is:

1. An air conditioning unit having a refrigeration circuit for transferring heat energy between air being circulated through the unit to a space to be conditioned and another fluid which comprises:

an economizer including a frame defining a horizontal, downwardly facing opening for an air flow path for allowing outdoor ambient air to enter the air conditioning unit;

a sliding non-rotating door assembly for selectively covering at least a portion of the opening defined by the frame to regulate the flow of outdoor ambient air through the economizer said sliding non-rotating door assembly horizontally slidable into said economizer; and means for displacing the door assembly relative to the frame defining the opening including a reversing motor, a shaft connected to the motor for rotational displacement about the shaft's longitudinal axis, and at least one rod connecting the shaft to the door, said at least one rod including a longitudinally extending aperture therein having interior surfaces in engagement with a first flat planar portion of said shaft wherein the rod may be rotated by and about the shaft while being displaced transversely relative to the shaft to slide said door between positions.

2. The apparatus as set forth in claim 1 and further comprising at least one pivot support mounted to extend from the door and wherein the rod is rotationally connected to the pivot support to effect sliding displacement of the door based upon a rotational displacement of the shaft by the motor.

3. An economizer assembly for directing outdoor ambient air into an air flow path including a fan for circulating air to an enclosure which comprises:

an economizer defining an air flow passageway for conducting outdoor ambient air into the air flow path including a frame assembly defining a downwardly facing horizontal opening through which the outdoor ambient air may enter the air flow passageway;

a sliding door positioned to mate with the frame assembly for controlling the air flow through said opening; and means for displacing the sliding door between various positions to effectively control what portion of the opening is not blocked by the door to thereby control the volume of outdoor ambient flow through the economizer including;

a motor for generating rotational movement;

a shaft connected to the motor to be caused to rotate by the motor; and at least one drive rod connected to both the shaft and the door for effecting sliding displacement of the door from rotational movement of the shaft, said drive rod having a longitudinally extending aperture therein with interior surfaces in engagement with a first flat planar portion of said shaft, wherein said rod may be rotated by said shaft while being displaced relative to said shaft.

4. The apparatus as set forth in claim 3 wherein the means for displacing further comprises:

a motor for generating rotational movement;

a shaft connected to the motor to be caused to rotate by the motor; and at least one drive rod connected to both the shaft and the door for effecting sliding displacement of the door from rotational movement of the shaft.

5. The apparatus as set forth in claim 3 wherein the sliding door further comprises at least one pivot support and wherein the drive rod is pivotally connected to the pivot support for effecting displacement of the door.

6. The apparatus as set forth in claim 5 wherein the motor is a reversising motor, wherein the shaft extends across the economizer and is supported at the end opposite from the motor by a bearing and wherein there are multiple rods to effect smooth sliding operation of the door.

* * * * *